United States Patent [19]

Schwendemann

[11] 4,452,305

[45] Jun. 5, 1984

[54] KICKOVER TOOL WITH PIVOT ARM RETRACTION MEANS

[75] Inventor: Kenneth L. Schwendemann, Lewisville, Tex.

[73] Assignee: Otis Engineering Corporation, Dallas, Tex.

[21] Appl. No.: 293,017

[22] Filed: Aug. 14, 1981

[51] Int. Cl.[3] ..... E21B 23/00

[52] U.S. Cl. ..... 166/117.5; 166/381

[58] Field of Search ..... 166/117.5, 117.6, 378, 166/379, 381, 382, 383

[56] References Cited

U.S. PATENT DOCUMENTS

| | | | |
|---|---|---|---|
| 3,732,928 | 5/1973 | Sizer | 166/383 |
| 3,837,398 | 9/1974 | Yonker | 166/117.5 |
| 4,026,363 | 5/1977 | Yonker et al. | 166/117.5 |
| 4,031,954 | 6/1977 | Herbert et al. | 166/117.5 |
| 4,051,895 | 10/1977 | Embree | 166/117.5 |
| 4,294,313 | 10/1981 | Schwegman | 166/117.5 |
| 4,375,237 | 3/1983 | Churchman | 166/117.5 |

*Primary Examiner*—Stephen J. Novosad
*Assistant Examiner*—William P. Neuder
*Attorney, Agent, or Firm*—Albert W. Carroll

[57] ABSTRACT

A kickover tool of the 90-degree type for installing well flow control devices in and removing such devices from offset receptacles of side pocket mandrels in wells, the kickover tool having a body, and a pivot arm, with tool carrier means attached thereto, pivotally mounted on the body for relative movement between aligned, kickover, and retracted positions, the kickover tool additionally including means not only for releasably retaining the pivot arm in aligned and kickover positions but also in retracted position.

9 Claims, 23 Drawing Figures

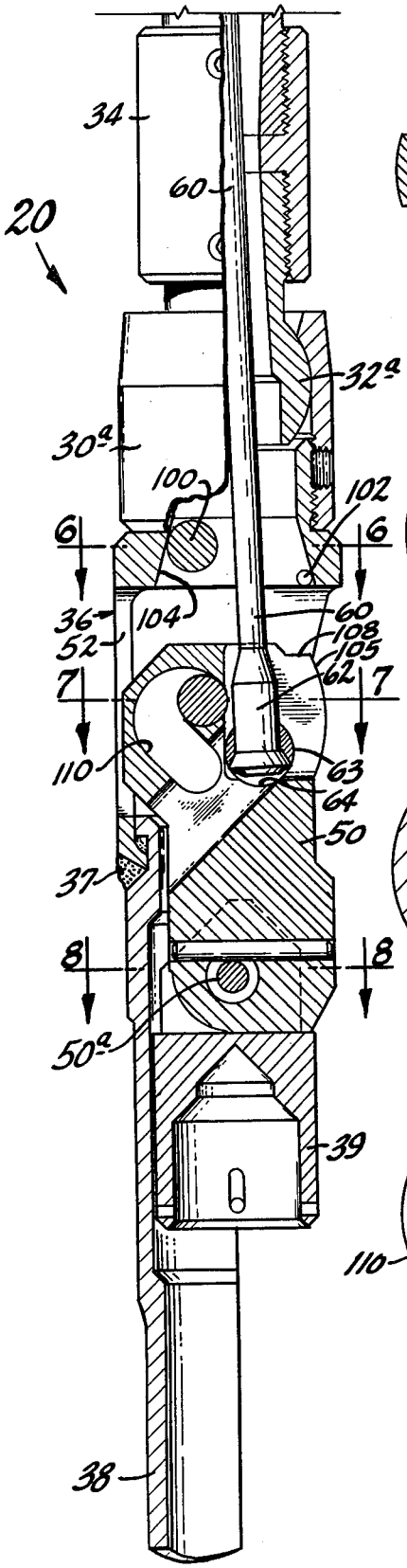
FIG. 1-C
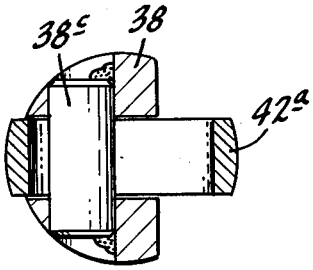
FIG. 9
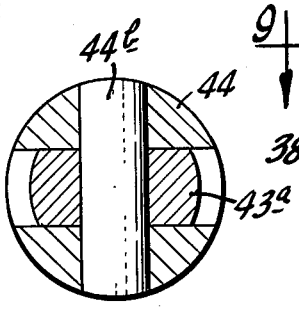
FIG. 10
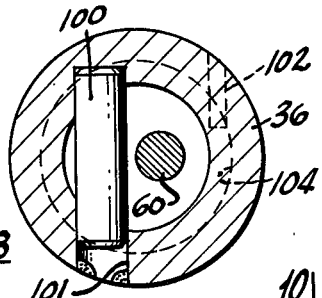
FIG. 6
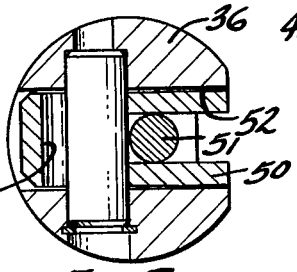
FIG. 7
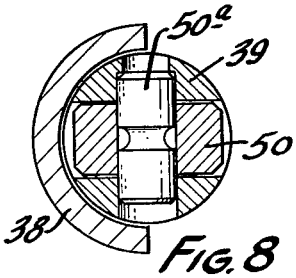
FIG. 8
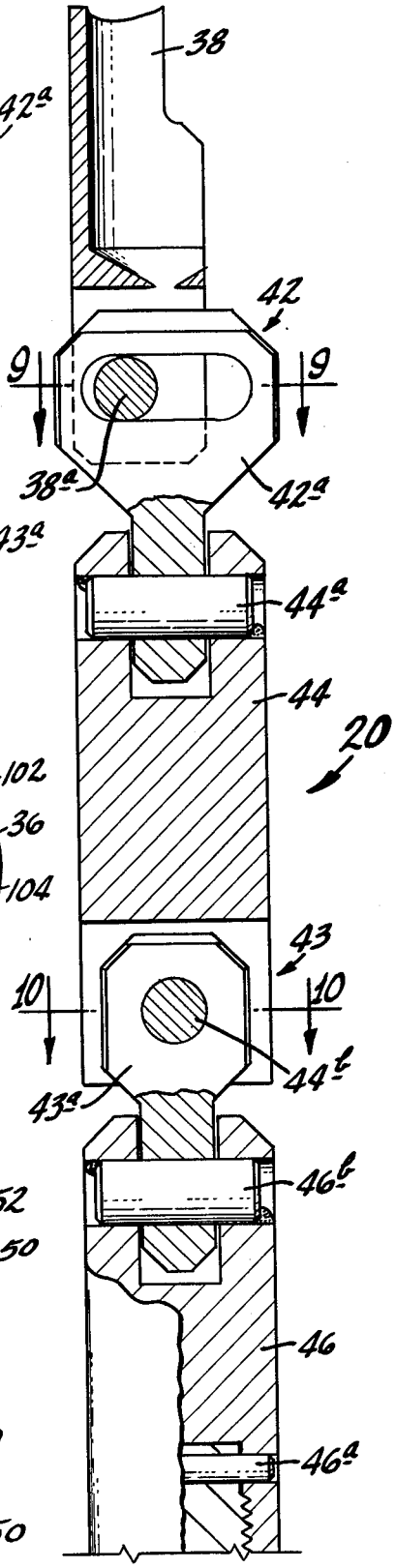
FIG. 1-D

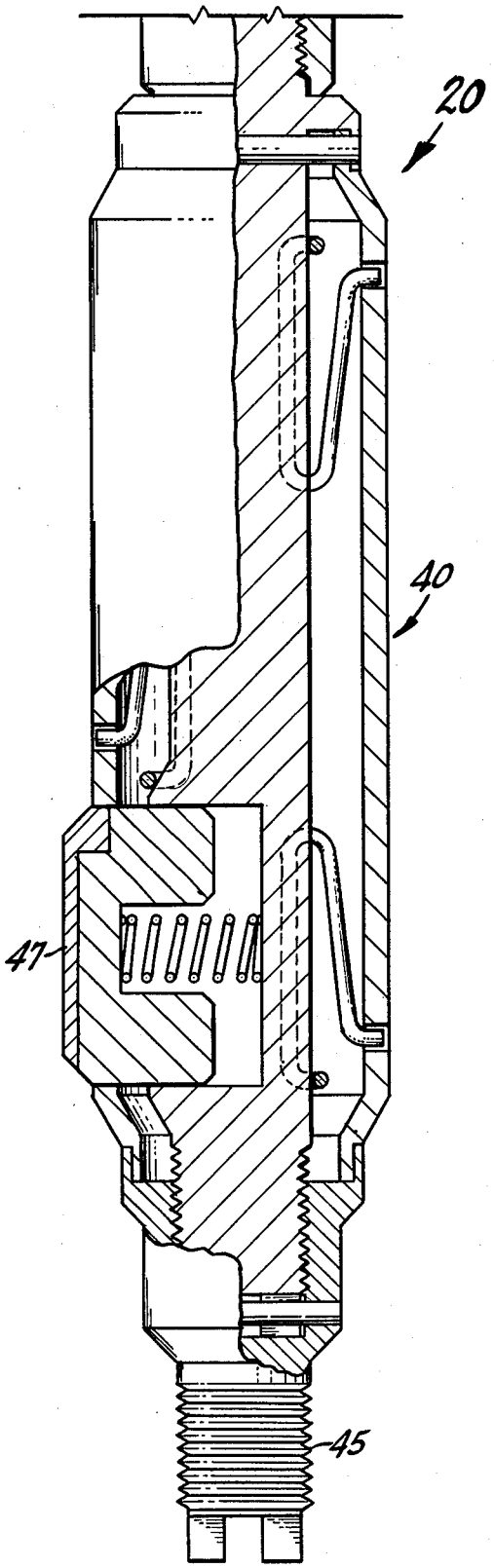
FIG. 1-E
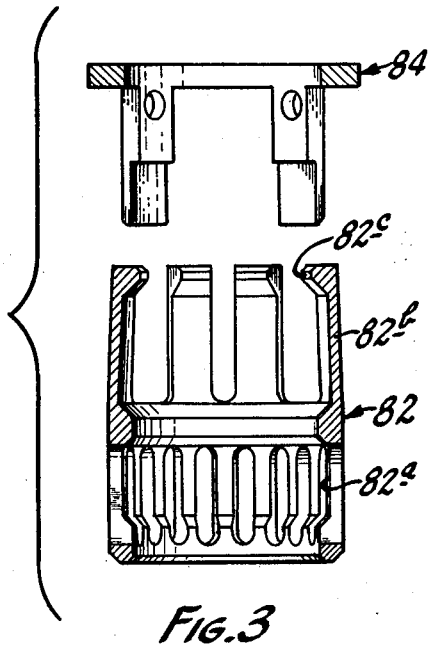
FIG. 3

KICKOVER TOOL WITH PIVOT ARM RETRACTION MEANS

BACKGROUND OF THE INVENTION

1. Field of the Invention

This invention relates to well tools and more particularly to tools for installing and removing flow control devices, such as gas lift valves, in gas lift wells equipped with side pocket mandrels.

2. Description of the Prior Art

Gas lift operations have been practiced for many years as a means of secondary recovery of oil from wells with formation pressures insufficient to produce without added help. In gas lift operations, gas is injected into the tubing-casing annulus at the surface and is afterwards admitted into the tubing at a point below the liquid level to aerate the liquid, decrease its flowing density, and aid in lifting it to the surface. Generally, gas lift valves control the admission of gas into the tubing. Usually several gas lift valves are used in a well and are scientifically located at strategic points to assure efficiency. Normally, one of the gas lift valves does most of the work at any given time while the others remain idle. Side pocket mandrels have been used widely to house gas lift valves in offset receptacles so that any one of the gas lift valves could be removed and replaced without disturbing the other gas lift valves in the well. To install and remove gas lift valves, and the like, in side pocket mandrels, a kickover tool is used.

While side pocket mandrels and kickover tools have been known for over 30 years, a new type became known in the early 1970's when a side pocket mandrel and kickover tool for pumpdown or through flow line (TFL) wells was introduced by Otis Engineering Corporation, Dallas, Texas, assignee of application for patent by Harry E. Schwegman for Kickover Tool, Ser. No. 490,557 filed July 24, 1974, now U.S. Pat. No. 4,294,313. This kickover tool was articulated to enable it to pass through flow lines containing bends having radii as short as 60 inches. The kickover tool had a pivot arm which would actuate to a position of about 90 degrees or normal to axis of the kickover tool in order to position a gas lift valve in axial alignment with the side pocket receptacle of a side pocket mandrel. Gas lift valves could then be pushed straight into or pulled straight from such receptacle. This arrangement required less space above the receptacle and permitted shortening of the side pocket mandrel by a considerable amount.

U.S. Pat. No. 3,837,398 issued Sept. 24, 1974 to John H. Yonker for a Kickover Tool is an improvement over the kickover tool of Schwegman. Yonker provided means in his kickover tool for releasably latching the pivot arm in kickover position. The Yonker patent is assigned to Otis Engineering Corporation (supra).

The present invention is an improvement over the Schwegman and Yonker inventions. Schwegman's application Ser. No. 490,557 and Yonker's U.S. Pat. No. 3,837,398 are hereby incorporated into this present application for all purposes.

The kickover tools of both Schwegman and Yonker were operative, but in each case their pivot arm remained spring biased after a flow control device was installed in or removed from the side pocket receptacle and its outer end, understandably, suffered much wear and damage as it was dragged along the pipe wall on the return trip out of the well. Worse yet, the pivot arm being spring pressed toward extended position prevented downward travel of the kickover tool in the well tubing which precluded occasional needful manipulation and made it sometimes difficult to retrieve the kickover tool from the well. Accordingly, for several years it was desired to provide means for automatically retracting the pivot arm upon completion of the downhole work to eliminate such wear on this expensive part and to eliminate its interference, permitting downward movement of the kickover tool when needed, thus facilitating retrieval of the tool from the well. The present invention fills this long-felt need in providing means in a kickover tool of the 90-degree type which causes the pivot arm thereof to be retracted after it has done its work downhole and holds it in retracted position during the return trip out of the well. This is not found in any of the prior art devices with which applicants are acquainted.

SUMMARY OF THE INVENTION

The present invention is directed to an improved kickover tool of the 90-degree type for installing well tools in or removing them from side pocket mandrels in wells, each of said mandrels having a body with a main bore, a belly offset from the main bore, and a well tool receiving bore alongside the main bore and opening into the belly so as to be accessible to tools lowered into the well from the surface, the kickover tool having a body, a pivot arm pivotally mounted on the body and having tool carrier means thereon, means for moving the pivot arm from an initial position of alignment to a kickover position wherein the tool carrier means therein is aligned with the receptacle bore, and back to a retracted position, and means for subsequently holding the pivot arm in retracted position.

It is therefore one object of this invention to provide a kickover tool of the type described having well tool carrier means thereon for carrying a well tool into a well for installation or removal in a side pocket mandrel.

Another object is to provide a improved kickover tool of the character described wherein the well tool carrier means is carried by pivot arm means carried on the kickover tool body and pivotable between aligned and kickover positions.

A further object is to provide a kickover tool having pivot arm means pivotable from aligned to kickover position and back again and is subsequently held in aligned position for the return trip out of the well.

Another object of the invention is to provide a kickover tool having well tool carrier means carried on pivot arm means pivotally mounted on the kickover tool and being pivotable between a first position in which it is aligned with the kickover tool body, a second position in which well tool carrier means thereon are aligned with the offset receptacle bore of a side pocket E Another object is third sition for withdrawal from the well.

Additional objects and advantages may become apparent from reading the description which follows and from studying the accompanying drawing, wherein:

FIGS. 1-A, 1-B, 1-C, 1-D, and 1-E taken together form a longitudinal view, partially in section and partially in elevation with some parts broken away, showing a kickover tool constructed in accordance with this invention ready for lowering into a well through use of through flow line (TFL) tools and techniques;

FIG. 3 is an exploded view showing the control collet and retaining ring of that section of the kickover tool shown in FIG. 1-B;

FIG. 6 is a cross-sectional view taken along line 6—6 of FIG. 1-C;

FIG. 7 is a cross-sectional view taken along line 7—7 of FIG. 1-C;

FIG. 8 is a cross-sectional view taken along line 8—8 of FIG. 1-C;

FIG. 9 is a cross-sectional view taken along line 9—9 of FIG. 1-D;

FIG. 10 is a cross-sectional view taken along line 10—10 of FIG. 1-D;

DESCRIPTION OF THE PREFERRED EMBODIMENT

Figure 13:
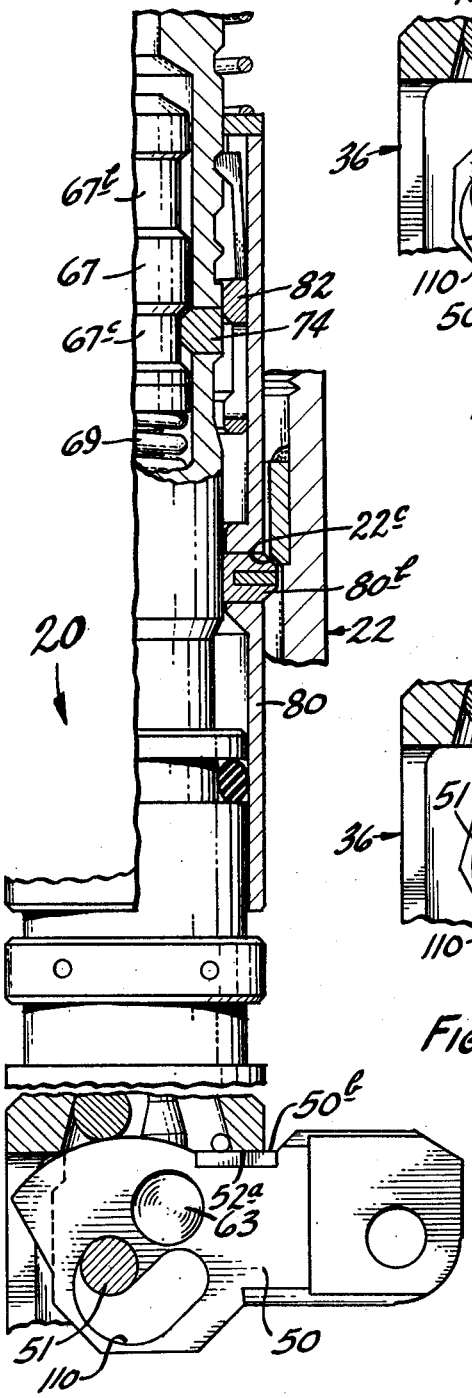
FIG. 13 is a fragmentary view of a portion of the kickover tool showing the pivot arm in kickover position.

Referring now to FIGS. 1-A through 1-E and 2–16, it will be seen that the kickover tool of this invention is indicated generally by the reference numeral 20. It is shown to be connected to a pumpdown (or TFL) tool string, indicated by reference numeral 21, for movement into and out of a well flow conductor (not shown) containing therein one or more side pocket mandrels such as that partially shown in FIGS. 13, 14, and 16 where it is indicated by the reference numeral 22. Well flow conductors and side pockets are well known in the art. Pumpdown tool strings are moved into and out of wells by pumped fluids such as water, salt water, oil, or the like, in a well-known manner as explained in U.S. Pat. No. 3,837,398 to Yonker and application Ser. No. 490,557, both incorporated by reference hereinabove.

Kickover tool 20 is coupled to pumpdown tool string 21 by an adapter 24 having its upper end attached to the lower end of such tool string as by a thread (not shown) while its lower end has a socket (not shown) connected to ball 25 on the upper end of sub 26 threaded onto the upper end of tubular body section or actuator body 28 which in turn has its lower end threadedly connected to the upper end of tubular body sub 29. Socket member 30, attached to the lower end of sub 29, houses ball member 32 connected to the upper end of coupler 34, and a like ball member 32*a* is attached to the lower end of coupler 34 and has its ball portion engaged in socket member 30*a* which may be identical to socket member 30. Balls 25, 32, and 32*a* engaged in their respective sockets provide the articulation necessary to enable the upper portion of the kickover tool 20 to negotiate the short-radius bends in the flow conductors through which it must pass during its trip into and out of a well, perhaps from a remote location.

Socket member 30*a* is threadedly connected to the upper end of pivot housing 36 which has its lower end welded as at 37 to the upper end of tray 38 which is generally semi-circular in cross section to receive and protect well tools such as tool 39*a* carried by tool carrier 39 attached to pivot arm 50 by pin 50*a*. The lower end of the tray 38 is connected to the upper end of the orienting section 40 by a pair of universal joints 42 and 43 mounted at opposite ends of link 44, thus providing flexibility necessary for the lower portion of the kickover tool to negotiate the short-radius bends in the well conduit mentioned earlier. The lower end of the orienting section 20 is threaded as at 45 to provide for attachment of other tools, such as, for instance, a guide, or another kickover tool, making it possible to pull a well tool from a side pocket mandrel and to immediately replace it with another in a single trip of the tools into the well, as taught in U.S. Pat. No. 3,732,928 to Phillip S. Sizer.

Figure 16:
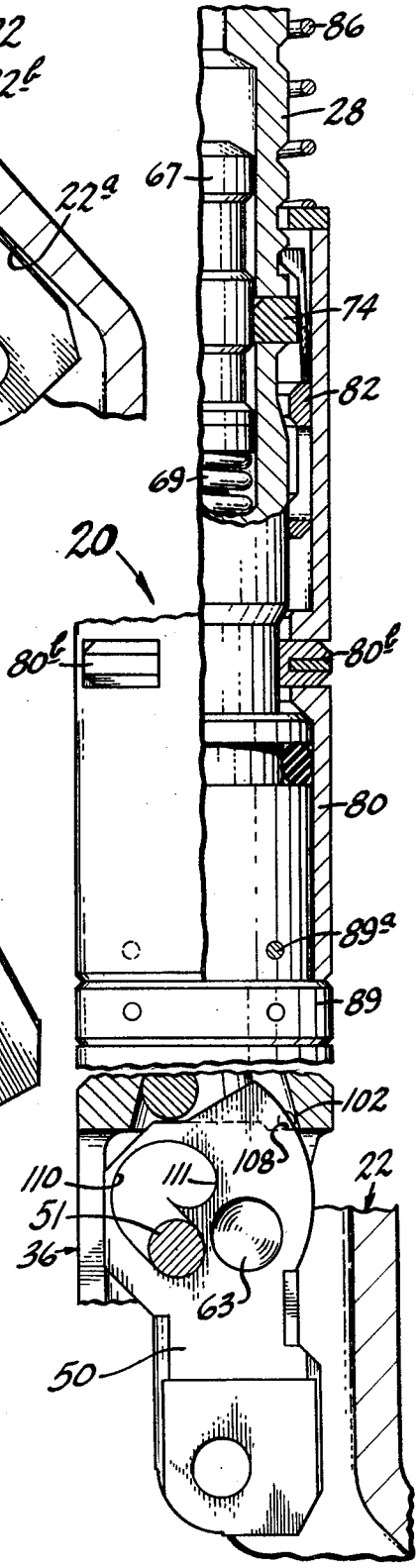
FIG. 16 is a fragmentary view similar to FIG. 13 but showing the kickover tool with its pivot arm returned to its fully retracted or third position and being held in this position by the bias of the actuator spring.

Pivot arm 50 is pivotally mounted on pivot body 36 by pivot pin 51. Pivot arm 50 is disposed in slot 52 in pivot body 36 which opens to the right-hand side of the body as seen in the drawing. The pivot arm 50 is pivotable relative to the pivot body between a first or aligned position, shown in FIG. 1-C, in which it is aligned with the kickover tool and a second or kickover position, shown in FIG. 13, in which it extends from slot 52 at substantially 90 degrees to the kickover tool and a third or retracted position in which it is again aligned with the kickover tool, as shown in FIG. 16.

For pivoting the pivot arm 50 from its first or aligned position to its kickover or second position, an actuator rod 60, disposed in the aligned central bores of the pivot body 36, ball members 32, 32*a*, coupler 34, sub 29, and actuator body 28, respectively, has its lower end connected by thimble 62 to anchor pin 63 disposed in aperture 64 as shown in FIG. 1-C. The upper end of actuator rod 60 is connected by thread 66 into the lower end of actuator mandrel 67, and this connection, after having been carefully adjusted to position mandrel 67 in proper relation to inner lugs 74, as previously explained, is secured by tightening lock nut 68 against the lower end surface of actuator mandrel 67. Spring 69 surrounds the actuator rod and has its lower end supported upon upwardly facing shoulder 70 in the sub 29 while its upper end applies an upward bias to the lower side of lock nut 68 tending to lift the actuator mandrel 67 and rod 60 attached thereto and to rotate pivot arm 50 about pivot pin 51 in a counter-clockwise direction as seen in the drawing and thus move it to extended or kickover position, shown in FIG. 13.

For setting the pivot arm 50 in its initially aligned position, shown in FIG. 1-C, preparatory to running the kickover tool into a well, pin 72 is removed and ball member 26 is unscrewed from the upper end of actuator body and a threaded rod (not shown) having a tapered tip on its reduced forward end is threaded into the upper end of actuator body 28 until its tapered tip engages in the depression 67*a* in the upper end of actuator mandrel 67. This special tool can then be screwed further inwardly to depress the actuator mandrel 67 and compress spring 69 as desired, during which action, pivot arm 50 is swung inwardly to aligned position. The operator sleeve 80 is then moved upwardly on the actuator body 28, against the compression of spring 86, to move collet 82 to the position shown in FIG. 1-B to move the lugs 74 inwardly into engagement with recess 67*b* of the actuator mandrel 67 and to hold them thus engaged. The threaded rod is then unscrewed to disengage its tapered tip from the depression 67*a*, leaving the lugs 74 thus engaged in the recess to maintain the actuator mandrel in its lowermost position wherein it acts through control rod 66 and pin 63 to hold the pivot arm 50 in its fully retracted position, shown in FIGS. 1-B and 1-C. The threaded rod is then unscrewed completely and removed from the actuator body 28 and the sub 26 having ball 25 on its upper end is reconnected to the upper end of the actuator body 28, after which this connection is made secure by re-installing pin 72. This connects the kickover tool 20 to the tool string 21 by which it is moved into and out of the well, as before explained.

Actuator mandrel 67 preferably has upper and lower external annular recesses 67*b* and 67*c*, respectively. Both recesses are engageable by inner lugs 74, but these lugs are initially engaged in upper recess 67*b* before the kickover tool is lowered into the well, as explained earlier. Inner lugs 74 are disposed as shown (FIG. 4) for radial movement in windows 75 of the surrounding actuator body to hold the actuator mandrel 67 and thus the actuator rod 60 depressed against the upward bias of spring 69. Thus, the rod 60 acting on pin 63 holds the pivot arm 50 in its initially aligned position as clearly shown in FIG. 1-C.

Operator sleeve 80 surrounds the actuator body 28 and is slidable longitudinally relative thereto. A collet 82 is disposed in the annular space between the operator sleeve 80 and the actuator body 28 and when in its initial position, shown in FIG. 1-B, has its lower end portion surrounding the inner lugs 74, confining them to their inner position where they engage the upper recess 67*b* of actuator mandrel 67.

The collet has an internal annular recess 82*a* near its lower end into which the lugs 74 may expand when this recess is aligned therewith. A plurality of collet fingers 82*b* extend upwardly from the collet 82 and each finger is provided with an internal boss 82*c* which cooperates with first, second, third, and fourth external annular recesses 28*a*, 28*b*, 28*c*, and 28*d*, respectively, formed on actuator body 28 as shown. Bosses 82*c* are shown in FIG. 1-B to be engaged in first recess 28*a* and thus position collet 82 so that lugs 74 cannot disengage actuator mandrel 67 and thus cannot permit spring 69 to expand and move pivot arm 50 to kickover position at this time.

Operator sleeve 80 has a plurality of windows 80*a* in which operator lugs 80*b* are mounted for radial movement. As shown, lugs 80*b* are expanded and extend beyond the outer periphery of the kickover tool. They are held expanded by enlargement or land 28*e* formed between recess 28*f* and reduced diameter 28*g* of the actuator body 28. When the operator sleeve is slidably moved to a position wherein lugs 80*b* are aligned either with recess 28*f* or with reduced diameter 28*g*, they may retract to an inner position in which they do not protrude beyond the tool periphery.

Retainer 84, better seen in FIG. 3, is telescoped into the upper end of operator sleeve 80 and is held in place by pins 85. A spring 86 surrounds the upper portion of kickover tool 20 and has its lower end supported on the upper end of retainer 84 attached to operator sleeve 80. The upper end of spring 86 bears upwardly against flange 87 of nut 88 screwed onto the upper end of actuator body 28 below sub 26. Spring 86 constantly biases operator sleeve 80 downwardly. When lugs 80*b* meet a restriction during the downward trip into the well, sleeve 80 is moved up against compression of spring 86 until lugs 80*b* retract into recess 28*f* of the actuator body. After such restriction has been passed, spring 86 returns sleeve 80 to the position shown in FIG. 1-B. Collet 82 having its finger bosses engaged in recess 82*c* is insufficient to limit downward movement of sleeve 80. For this reason, o-ring 29*a* is provided in a suitable external annular recess in sub 29 and engages the inner wall of operator sleeve 80 as shown to provide the drag or resistance necessary to prevent the spring 86 from moving the collet 82 and sleeve 80 too far too easily and, thus, keep it under control. This added resistance is particularly needed to prevent unwanted movement of the collet when the kickover tool is subjected to sudden stops and the like as by jars and also when the lugs 80*b* pass a restriction and spring 86 suddenly drives the sleeve 80 downwardly.

When the kickover tool is lifted in a side pocket mandrel such as that shown in Yonker U.S. Pat. No. 3,837,398 or Schwegman's application Ser. No. 490,557, and lugs 80*b* engage the actuating shoulder 22*a* therein, sleeve 80 is arrested and further upward movement of the tool causes collet fingers 82*b* to lodge against retainer 84 and additional movement of the tool causes the collet 82 to move relatively downwardly on the actuator body until its collet fingers engage recess 28*b*. During this relative movement between the collet 82 and the actuator body, the inner recess 82*a* of the collet became aligned for a time with lugs 74 which promptly moved outwardly thereinto, disengaging actuator mandrel 67 and permitting spring 69 to lift it to its upper position while lifting operator rod 60 and swinging the pivot arm 50 to its second or kickover position seen in FIG. 13. As soon as this is accomplished, the collet forces lugs 74 inwardly where they engage lower recess 67*c* of the actuator mandrel to lock it in this upper position. The fingers of collet 82 then engage second recess 28*b* of the actuator body and this positions the collet to again confine lugs 74 to their inner position seen in FIG. 13 and thus lock the pivot arm in kickover position. In this position, the tool carrier attached to the pivot arm is aligned with the offset receptacle in the side pocket mandrel. Note, however, that operator sleeve 80 did not move down on actuator body far enough to permit lugs 80*b* to retract and disengage the locator shoulder in the side pocket mandrel, although it could move so far that its lower end would engage shear ring 89 and the collet finger bosses 82*c* would engage third recess 28*c* of the actuator body.

Figure 14:
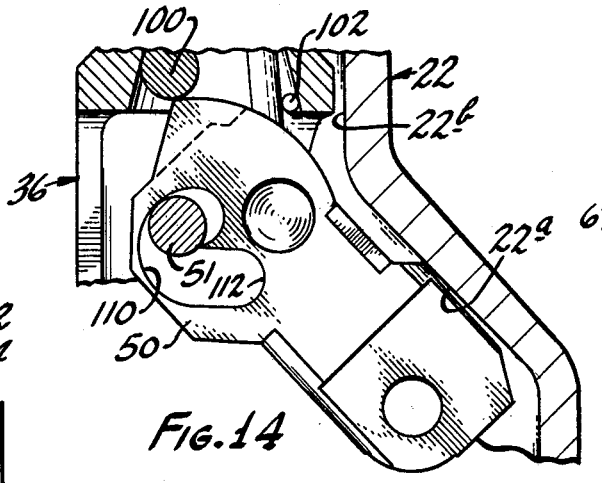
FIG. 14 is a fragmentary view similar to FIG. 13 but showing the pivot arm being forced toward retracted position as the kickover tool is withdrawn from the side pocket mandrel.
Figure 15:
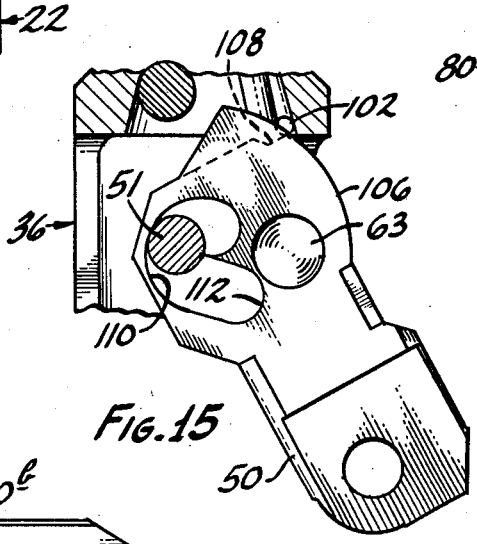
FIG. 15 is a fragmentary view similar to FIG. 14 showing the pivot arm with the pivot pin ready to move from the short leg to the long leg of the J-shaped slot thereof.

The kickover tool is then moved downwardly in the side pocket mandrel and lifted again to install a device such as a gas lift valve in the offset receptacle bore or to remove such a device therefrom. Continued lifting of the kickover tool after it has accomplished its task of depositing or picking up a device will bring lugs 80*b* again into engagement with the locator shoulder (not shown) in the side pocket mandrel 22 and this time a greater lifting force is applied to the kickover tool. At a predetermined force, the kickover tool will move upwardly relative to the operator sleeve and shear ring 89, shearing the tangential shear pins 89*a* and permitting lugs 80*b* to retract into the reduced diameter 28*g* of the actuator body 28 and thus disengage the mandrel locating shoulder, permitting the kickover tool to be withdrawn from the side pocket mandrel as shown in FIGS. 14–16.

As the kickover tool is withdrawn from the side pocket mandrel 22, the pivot arm extending therefrom engages the restricted upper portion of the side pocket mandrel body as at 22*a* and is automatically pivoted towards its retracted position. The opening in the upper end of the side pocket mandrel, as at 22*b*, as well as the diameter of the bore of the tubing (not shown) is sufficiently large to permit free passage of the kickover tool 20 therethrough but is not so small that it in itself is able to pivot the pivot arm to its fully retracted position. If it could, it would be an easy matter to latch the pivot arm in its retracted position, enabling the kickover tool to be lowered in the tubing without the pivot arm causing it to lodge and, thus, making it possible to work the tool up and down in the tubing to free it should it become stuck or lodged by other means, such as by debris or the like. If the pivot arm could be pivoted to fully retracted position, it would likely be possible to latch it in this position again through use of lugs 74 engaging upper recess 67*b* of actuator mandrel 67 as is shown in FIG. 1-B. But, this is not practical.

However, other means are provided for fully retracting the pivot arm and holding it in that position. For this reason, pivot body 36 is provided with shoulder or shoulder pin 100 which is disposed in a transverse hole 101 therethrough just above the upper end of slot 52 and just to left of center as seen in FIG. 1-C. This pin 100 is clearly seen in FIG. 6.

Fulcrum pin 102 passes through the wall of pivot body 36, and its inner end projects into the tapered bore 104 at a level near the upper end of slot 52. The fulcrum pin is shown in dotted lines in FIG. 6.

Pivot arm 50 has a pair of arcuate guide surfaces 105 and 106 which are concentric about pivot pin 51 when the pivot arm is in its initial position depicted in FIG. 1-C. Guide surface 106 is better seen in FIG. 11 where it is seen to be on the near side of the pivot arm 50 (toward the viewer). Guide surface 105 is on the far side (see FIG. 1-C) and does not extend upwardly as far as does guide surface 106. Guide surface 105 terminates at its upper end (as seen in FIGS. 1-C and 11) with shoulder 108.

Guide surfaces 105 and 106 and pivot arm shoulder 108 cooperate with pins 100 and 102 in a manner soon to be described.

Figures 2, 4, 5, 11, 12:
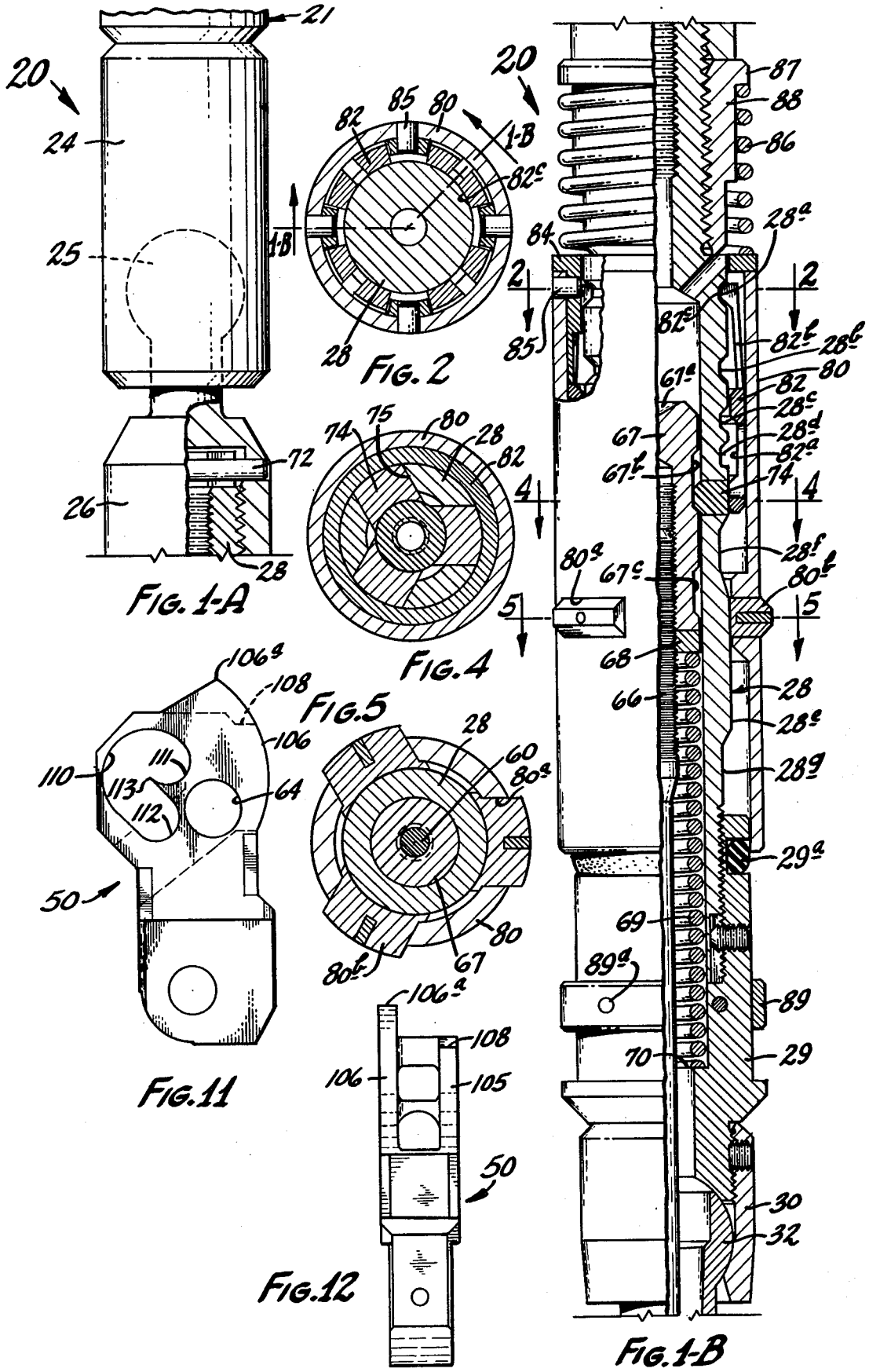
FIG. 2 is a cross-sectional view taken along line 2—2 of FIG. 1-B.
FIG. 4 is a cross-sectional view taken along line 4—4 of FIG. 1-B.
FIG. 5 is a cross-sectional view taken along line 5—5 of FIG. 1-B.
FIG. 11 is an elevational view of the pivot arm seen in longitudinal section in FIG. 1-C.
FIG. 12 is a side view looking from the right-hand side of the pivot arm of FIG. 11.

In FIG. 11, pivot arm 50 is seen to have a pivot pin hole 110 passing therethrough, and this hole is shaped like the letter "J". Thus the hole 110 has a short leg 111 and a long leg 112. Between these two legs is a finger or projection 113. This hole or J-shaped slot is sufficiently wide to accommodate pivot pin 51 at any point therealong.

In the first or aligned position of the pivot arm, as seen in FIG. 1-C, the pivot pin occupies or is at the end of the short leg 111 of the hole or J-shaped opening 110 of the pivot arm. The pivot pin 51 remains in the short leg 111 even when it is swung to its fully extended or kickover or second position as is clearly seen in FIG. 13.

It will be readily understood that before the pivot arm reaches its kickover position (FIG. 13), guide surfaces 105 and 106 engage shoulder pin 100 which prevents spring 69 and actuator rod 60 from lifting the inner end of the pivot arm and allowing the pivot pin to move out of its position at the end of the short leg 111 of the J-shaped hole in the pivot arm. Thus with guide surfaces 105 and 106 engaged with shoulder pin 100 and the upper edge of the pivot arm 50 at 50*b* engaged with the upper end 52*a* of slot 52, and with the lugs 74 firmly locked in engagement with lower recess 67*c* of the actuator mandrel 67 by collet 82, the pivot arm is locked in kickover position and cannot be pivoted about pivot pin 51 in either clockwise or counter-clockwise direction.

As the kickover tool is withdrawn through the restricted upper end 22*b* of the side pocket mandrel 22 and the extended pivot arm contacts the mandrel wall in the area indicated by the reference number 22*a* (by this time pins 89 have been sheared and lugs 74 have freed actuator mandrel 67), continued upward movement of the kickover tool causes the pivot arm 50 to rotate clockwise toward retracted position. At first guide surfaces 105 and 106 slide along pin 100, but when the end of guide surfaces 106 reaches pin 100, the pivot arm begins to move to the right, the short leg of the J-shaped hole now approaching horizontal as seen in FIG. 14. As the pivot pin nears the leftmost extent of the J-shaped hole, the corner 106*a* at the end of guide surface 106 starts around the curved surface of shoulder pin 100 while the pivot pin 51, now in contact with the finger or projection 113 between the legs 111 and 112 of the J-shaped hole, causes the pivot arm to pivot as clearly seen in FIG. 15, thus bringing the shoulder 108 at the end of guide surface 105 into a position of engagement with fulcrum pin 102. To this time, the pivot arm has been moved toward retracted position because it was dragging the wall of the restricted portion of the side pocket mandrel as the kickover tool was withdrawn therefrom.

Now, with shoulder 108 of the pivot arm 50 engaged with fulcrum pin 102 of the pivot body, and with the upward force applied to the pivot arm by the spring 69 acting through rod 60 connected to anchor pin 63 in the pivot arm, the pivot arm will pivot about fulcrum pin 102, the slot 110 of the pivot arm moving relative to the pivot pin 51. The pivot arm 50 will thus continue to move toward retracted position until pivot pin 51 occupies the end of the long leg of J-shaped hole 110 as seen clearly in FIG. 16. It will be noted in this view that the shoulder 108 remains engaged with fulcrum pin 102; that the spring 69 continues its upward bias on the pivot arm tending to pivot it further, although the pivot arm is already fully retracted; and that since the pivot pin 51 is now in the long leg 112 of slot 110 whereas it was initially in the short leg 111, the pivot arm is in a higher position in the pivot body than it was initially, as shown in FIG. 1-C.

Thus, it has been shown that an improved kickover tool of the 90-degree type has been provided which is similar in many respects to the kickover tool illustrated and described in U.S. Pat. No. 3,837,398 but which has additional means for latching or retaining its pivot arm in retracted position, and that such means is responsive to withdrawal of the kickover tool from a side pocket mandrel after the kickover tool has been used to install a well tool in or remove such a tool from the offset receptacle in the side pocket mandrel.

The kickover tool 20 is operated in the same manner as is the kickover tool of the Schwegman application Ser. No. 490,557 or the kickover tool of the Yonker U.S. Pat. No. 3,837,398 which is an improvement over the Schwegman kickover tool in that Yonker releasably locks his pivot arm in kickover position.

To operate the kickover tool 20, it is placed in the condition shown in FIGS. 1-A through 10. If a well tool is to be installed in a side pocket mandrel, the running tool 39 is attached to the lower or outer end of the pivot arm 50. If a well tool is to be retrieved from a side pocket mandrel, a pulling tool is used in the stead of the running tool 39. These running and pulling tools may be exactly the same as those shown in the Yonker patent or Schwegman application, supra. New shear pins 89*a* are used to pin shear ring 89 in place. The kickover tool is attached to a pumpdown tool train and moved into the well by pumping fluids into the well conduit which contains the side pocket mandrel in which the tool installation or removal operation is to be performed.

The tool train is moved to a position just below or past the selected one or perhaps several identical side pocket mandrels, each having a location shoulder or ring in its upper end and an orienting sleeve in its lower end. The circulation of fluids is reversed to move the kickover tool slowly upwardly into the selected side pocket mandrel. The kickover tool will be oriented by engagement of key 47 of orienting section 40 engaging the orienting sleeve in the lower portion of the side pocket mandrel, then it will lodge when its expanded outer lugs 80*b* engage the locator shoulder in the top of the mandrel, and a little additional movement will cause the actuating mechanism to pivot the pivot arm from aligned to kickover position, as previously explained. The circulation of fluids is reversed and the kickover is moved downwardly slowly to either insert a well tool into the offset receptacle or to engage a well tool already there, as the case may be. Once again, the circulation of fluids is reversed and the kickover tool is lifted, leaving the newly installed tool in the receptacle, or extracting from the receptacle a previously installed tool, as the case may be. As circulation of fluids continues, the kickover tool moves upwardly until it lodges with its outer lugs 80*b* in engagement with the locator ring of the side pocket mandrel as before. This time, fluid pressure is allowed to build against the tool train until the kickover toll moves upwardly again, shearing pins 89*a* and permitting the operator sleeve to move down to the position shown in FIG. 16 to thus allow inner lugs 74 to move outwardly to unlock the actuator mandrel 67 and, of course, unlock the pivot arm, as before explained.

As the kickover tool moves further upwardly, the extended pivot arm is moved toward retracted position because of this portion of the kickover tool entering the restricted upper end of the mandrel, as seen in FIG. 14. When the pivot arm reaches the FIG. 15 position, spring 69 and the parts directly associated therewith will cause the pivot arm to pivot to its fully retracted position, shown in FIG. 16, and will hold it in the thus fully retracted position during the entire return trip out of the well flow conductor.

Figure 17:
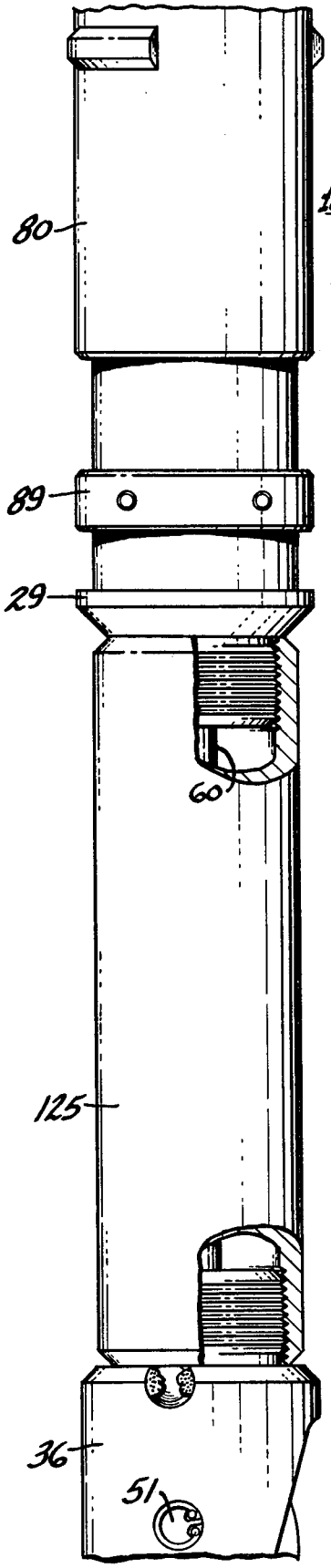
FIG. 17 is a fragmentary elevational view of the kickover tool with some parts broken away showing a portion near its upper end as it would appear when adapted for lowering into a well on a wireline.
Figure 18:
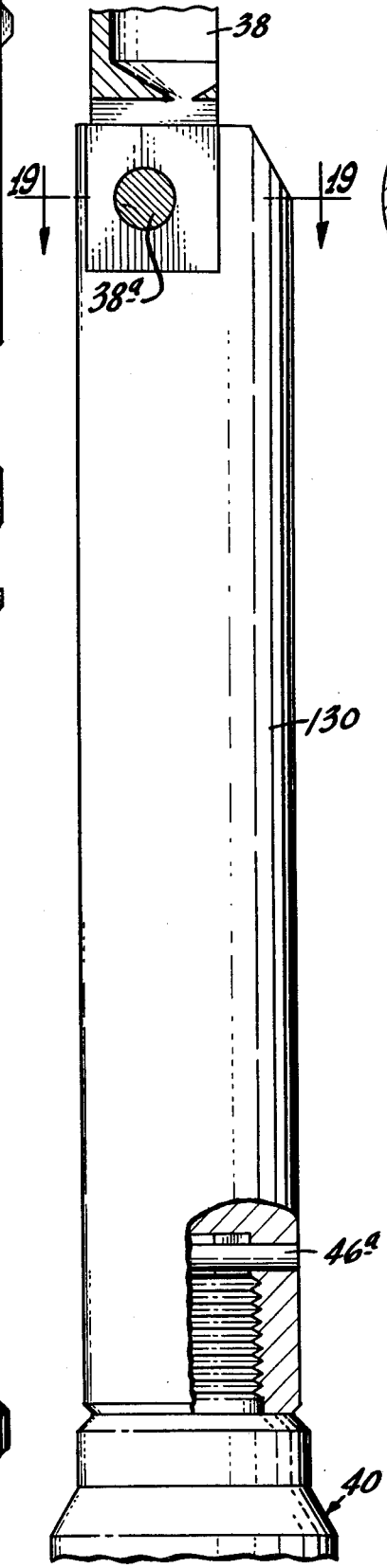
FIG. 18 is a fragmentary view similar to FIG. 17 but showing a lower portion of the kickover tool as it would appear when adapted for lowering into a well on a wireline.
Figure 19:
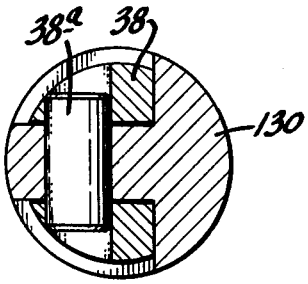
FIG. 19 is a cross-sectional view taken along line 19—19 of FIG. 18.

The kickover tool 20 can be readily modified for use with conventional wireline equipment by replacing most of the articulated joints with stiff connections. For instance, that portion between sub 29 and pivot body 36 which includes socket 30, ball member 32, coupler 34, ball member 32*a* and socket 30*a*, is removed and replaced by upper spacer 125, after which that portion of the modified kickover tool will appear as shown in FIG. 17. Further, the link 44 and the universal joints 42 and 43 attached thereto as well as sub 46 are removed and replaced by lower spacer 130 so that that portion of the modified kickover tool will appear as shown in FIG. 18. The modified kickover tool may be used with wireline equipment in the well-known manner for installing or removing well tools.

Thus, it has been shown that the kickover tool of this invention is able to accomplish all of the objects set forth herein. It should be understood however that while only the preferred embodiments have been illustrated and described hereinabove, other embodiments or variations might be had by changing sizes, shapes, or arrangement of some of the parts without departing from the true spirit of the invention, which is determined by the scope of the claims appended hereto.

We claim:

1. A 90-degree type kickover tool for installing well tools in or removing well tools from side pocket mandrels in well bores, each said side pocket mandrel having a body with a main bore, a belly offset from the main bore, and a receptacle bore alongside the main bore and accessible to tools lowered into the well from the surface, said kickover tool comprising:

a. an elongate body;

b. pivot arm means having tool carrier means thereon and having a J-shaped transverse slot therethrough;

c. a pivot pin passing through said J-shaped slot and having its ends received in aligned apertures in said body, said pin and slot connection allowing pivotal and sidewise movement of said pivot arm means relative to said body between first, second and third positions;

d. means for pivoting said pivot arm means approximately 90 degrees between said first position in which said pivot arm is substantially aligned with the longitudinal axis of said body and said second position in which the tool carrier means thereon is substantially aligned with the receptacle bore in the offset belly of the side pocket mandrel and said third position in which said pivot arm is again substantially aligned with said body; and e. means for holding said pivot arm means in said third position.

2. The kickover tool of claim 1, including:

a. shoulder pin means on said body; and b. cam means on said pivot arm means engageable with said pin means on said body for controlling said sidewise movement of said pivot arm means as it is moved from said second to said third position.

3. The kickover tool of claim 2, including:

a. fulcrum pin means on said body; and b. shoulder means on said pivot arm means engageable with said fulcrum pin means to hold said pivot arm means in said third position.

4. A 90-degree kickover tool for installing well tools in or removing well tools from side pocket mandrels in well bores, each said side pocket mandrel having a body with a main bore, a belly offset from the main bore, and a receptacle bore alongside the main bore and accessible to tools lowered into the well from the surface, said kickover tool comprising:

a. an elongate body;

b. pivot arm means having well tool carrier means thereon and pivotally mounted on said body for movement between aligned, extended, and retracted positions, said retracted position of said pivot arm means being displaced along the longitudinal axis of said kickover tool from said aligned position;

c. means for pivoting said pivot arm means approximately 90 degrees from aligned position wherein it is substantially aligned with the longitudinal axis of said body to extended position in which the well tool carrier means thereon is substantially aligned with said receptacle bore in said offset belly;

d. means for moving said pivot arm means from said extended position to said retracted position in which said pivot arm means is in substantial alignment with the longitudinal axis of said kickover tool, said means for moving said pivot arm means from aligned to kickover position and back to retracted position including:

i. pivot pin means disposed in aligned apertures of said pivot arm means and said body, said aperture of said pivot arm means being J-shaped and having a short leg and a long leg separated by a finger-like projection, ii. operating pin means mounted in said pivot arm means and spaced from said J-shaped slot and attached to biasing means for pivoting said pivot arm means about said pivot pin means, iii. first shoulder means on said body and guide means on said pivot arm means engageable to cause said short leg of said J-shaped aperture to cooperate with said pivot pin means to cause said pivot arm means to move from said aligned to said kickover position in response to an upward force applied to said operating pin means, and iv. second shoulder meas on said body and shoulder means on said pivot arm means engageable to cause said pivot arm means to pivot to retracted position responsive to said kickover tool being withdrawn from the side pocket mandrel, the long leg of the J-shaped slot of the pivot arm means moving into engagement with said pivot pin during such retracting movement, said second shoulder means of said body and said shoulder means of said pivot arm means remaining in engagement; and e. biasing means applying an upward force to said pivot arm means for holding said pivot arm means in said retracted position.

5. The kickover tool of claim 4 wherein said retacted position of said pivot arm means is higher in said body than is said initially aligned position.

6. The kickover tool of claim 4, including:

a. shoulder pin means on said body; and b. cam means on said pivot arm means engageable with said shoulder pin means for controlling said sidewise movement of said pivot arm means as it is moved from said extended to said retracted position.

7. The kickover tool of claim 6, including:

a. fulcrum pin means on said body; and b. shoulder means on said pivot arm means engageable with said fulcrum pin means to hold said pivot arm means in said retracted position.

8. A 90-degree kickover tool for installing well tools in or removing well tools from side pocket mandrels in well bores, each side pocket mandrel having a body with a main bore, a belly offset from the main bore, and a receptacle bore alongside the main bore and accessible to tools lowered into the well from the surface, said kickover tool comprising:

a. an elongate body;

b. pivot arm means having tool carrier means thereon and having a J-shaped transverse slot therethrough;

c. a pivot pin disposed in said J-shaped slot and having its opposite ends engaged in aligned apertures in said body, said pin and slot connection allowing pivotal and sidewise movement of said pivot arm means relative to said body between aligned, extended, and retracted positions;

d. means including a spring operatively associated with said pivot arm means for pivoting said pivot arm means about said pivot pin through approximately 90 degrees from said initially aligned position to said extended position to align said tool carrier means thereon with said receptacle bore;

e. means on said pivot arm means and said body coengageable during movement of said pivot arm means from extended to retracted position, said spring subsequently applying a force to said pivot arm means causing it to rotate about said coengaged means of said pivot arm means and said body to rotate said pivot arm means further toward fully retracted position and to maintain said pivot arm means in said retracted position.

9. The kickover tool of claim 8 wherein said retracted position of said pivot arm means is higher in said body than is said aligned position.

* * * * *